US005945916A

United States Patent [19]

Collot

[11] Patent Number: 5,945,916

[45] Date of Patent: Aug. 31, 1999

[54] INDICATOR LIGHT WITH IMPROVED LIGHT SPREADING MEANS

[75] Inventor: Patrice Collot, Pantin, France

[73] Assignee: Valeo Vision, Bobigny Cedex, France

[21] Appl. No.: 08/804,013

[22] Filed: Feb. 21, 1997

[30] Foreign Application Priority Data

Feb. 23, 1996 [FR] France ..... 96 02245

[51] Int. Cl.[6] ..... G08B 5/00

[52] U.S. Cl. ..... 340/815.4; 340/468; 340/815.75; 340/815.76; 359/454; 362/328; 362/332; 362/333

[58] Field of Search ..... 340/815.4, 815.73, 340/815.74, 815.75, 815.76, 468; 359/528, 530, 534, 457, 455, 459, 454, 726, 727, 728; 362/538, 307, 308, 328, 332, 333

[56] References Cited

U.S. PATENT DOCUMENTS

| | | | |
|---|---|---|---|
| 3,710,095 | 1/1973 | Donohue et al. | 362/348 |
| 4,733,946 | 3/1988 | Cossetti | 359/534 |
| 5,046,818 | 9/1991 | Barnes | 359/527 |
| 5,160,192 | 11/1992 | Sugawara | 362/333 |
| 5,243,402 | 9/1993 | Weber et al. | 356/429 |
| 5,245,515 | 9/1993 | Schwaller et al. | 362/72 |
| 5,287,101 | 2/1994 | Serizawa | 340/815.76 |
| 5,412,492 | 5/1995 | Zammit et al. | 359/48 |
| 5,440,456 | 8/1995 | Bertling et al. | 362/328 |
| 5,556,194 | 9/1996 | Natsume et al. | 362/328 |
| 5,582,481 | 12/1996 | Natsume | 362/332 |
| 5,614,045 | 3/1997 | Takuma et al. | 359/456 |

FOREIGN PATENT DOCUMENTS

| | | |
|---|---|---|
| 0 485 818 A1 | 5/1992 | European Pat. Off. . |
| 0 485 818 B1 | 5/1992 | European Pat. Off. . |
| 0 639 740 A1 | 2/1995 | European Pat. Off. . |
| 1 054 934 | 4/1959 | Germany . |

OTHER PUBLICATIONS

French Search Report dated Nov. 18, 1996.

*Primary Examiner*—Edward Lefkowitz
*Assistant Examiner*—Davetta Woods
*Attorney, Agent, or Firm*—Morgan & Finnegan, L.L.P.

[57] ABSTRACT

A motor vehicle indicator light comprises a light source, a reflector defining an axis on which the light source lies, the reflector having striations in a first orientation, and an optical plate having striations in a second orientation substantially at right angles to the first orientation. A central zone of the reflector spreads the light in a first direction in a first angular gap defined on either side of the axis, while the striations in two side zones of the reflector spread the light while directing it towards the axis of the reflector in the first direction. A homologous central zone of the optical plate, which may be an intermediate screen, spreads the light in a second direction substantially at right angles to the first direction, in a second angular gap on either side of the axis, while homologous side zones of the intermediate screen spread the light in the second direction to a lesser extent than the central zone.

19 Claims, 6 Drawing Sheets

INDICATOR LIGHT WITH IMPROVED LIGHT SPREADING MEANS

FIELD OF THE INVENTION

The present invention relates in general terms to side lamp displays for motor vehicles. The term "side lamp display" in this context means a light carried by a vehicle, the general purpose of the display being not to provide illumination, but rather to give an indication of something to an observer.

In this specification and in the Claims, the term "indicator light" will be used to denote the kind of side lamp display to which the invention relates. Thus, more particularly, the invention relates to an indicator light of a kind which is adapted to have a reduced field of emitted light, or illuminating field, while having photometric characteristics and visual appearance which are entirely satisfactory.

BACKGROUND OF THE INVENTION

In the state of the art, various arrangements are known for producing an indicating light beam which conforms to given photometric criteria, by the combined effects of a flux recuperating reflector and an optical plate. One such indicator light is described in European patent specification No. EP 0 639 740A. However, and in particular in respect of light beams which make it necessary to provide the highest possible light intensity and solid emission angle, it is necessary to make use of a reflector, or mirror, that recuperates a high proportion of the flux emitted by the light source, or lamp, of the indicator light. As a result, the reflector has to be made quite large. It follows from this that the indicator light as a whole occupies a large amount of space, as regards both its depth and its height and/or width.

In many cases, this type of known indicator light is not very suitable, especially since there is a current tendency among styling designers of motor vehicles to seek an indicator light which is both powerful and homogeneous, and which has a small illuminating field, while also having reduced size.

DISCUSSION OF THE INVENTION

The object of the present invention is to provide an indicator light which overcomes the above drawbacks.

According to the invention an indicator light for a motor vehicle, comprising a light source, a flux recuperating reflector having an axis on which the light source lies, the reflector having a plurality of striations defining a first orientation, and an optical plate having a plurality of striations defining a second orientation substantially at right angles to the said first orientation, is characterised in that the reflector has a central zone, the striations of which spread the light in a first direction and in a given first angular gap on either side of the axis of the reflector, together with two side zones, the striations of which spread the light while directing it towards the axis of the reflector in the said first direction, and in that the optical plate has a central zone which is essentially homologous with the central zone of the reflector, the striations in this central zone spreading the light in a second direction which is substantially at right angles to the said first direction, and in a given second angular gap on either side of the axis of the reflector, together with side zones which are essentially homologous to the side zones of the reflector, with the striations in the side zones of the optical plate spreading the light in the said second direction by a lesser amount than that of the spread given by the striations in the central zone of the said plate.

The said optical plate may constitute an intermediate screen, the indicator light then further including an essentially smooth cover lens. Alternatively, the said optical plate may itself constitute a closure lens of the indicator light, the striations of the said optical plate then being arranged on its inner face.

According to a preferred feature of the invention, the striations on the reflector are essentially horizontal, the striations of the optical plate then being essentially vertical, and the side zones of the reflector and those of the optical plate being upper and lower zones. In preferred versions of this arrangement, the striations in the upper zone of the reflector divert the light downwardly, while spreading it vertically about a descending mean inclination, and the striations of the lower zone of the reflector divert the light upwardly while spreading it vertically about a rising mean inclination.

Preferably then, the striations of the upper zone of the reflector put the light substantially between two planes which are inclined downwardly by about 5 degrees and about 10 degrees, respectively, with respect to the horizontal, and the striations in the lower zone of the reflector put the light substantially between two planes which are inclined upwardly by about 5 degrees and about 10 degrees, respectively, with respect to the horizontal.

According to another preferred feature of the invention, the striations in the central zone of the reflector put the light substantially between two planes which are inclined symmetrically upwardly and downwardly respectively with respect to the horizontal. The said symmetrically inclined planes are preferably inclined by about 8 degrees on either side of the horizontal.

The striations in the central zone of the optical plate are preferably cylindrical striations of constant radius. The striations in the side zones of the optical plate are then preferably striations having a radius which increases progressively from the interior towards the associated edge of the plate. Preferably then, the radius of the striations in the central zone of the optical plate is equal to the minimum radius of the adjacent striations in the side zones of the said plate, the said striations being aligned with each other.

The optical plate preferably further includes a Fresnel lens aligned with the light source; means for spreading the light are preferably arranged on the optical plate in association with the Fresnel lens.

According to a further preferred feature of the invention, the reflector has a horizontal or vertical dimension which is greater than the corresponding dimension of at least a working part of the optical plate.

Further features, objects and advantages of the present invention will appear more clearly on a reading of the following detailed description of a preferred embodiment of the invention, which is given by way of non-limiting example only and with reference to the accompanying drawings.

DESCRIPTION OF A PREFERRED EMBODIMENT OF THE INVENTION

Figure 1:
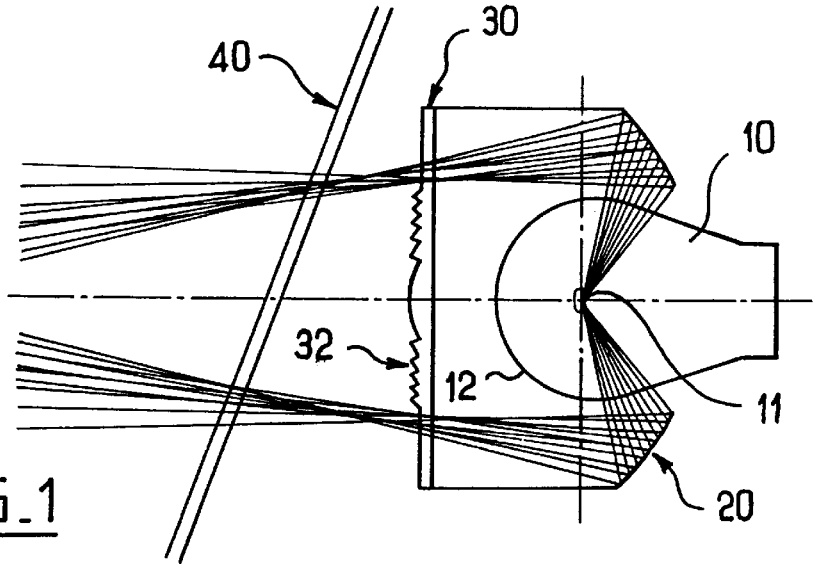
FIG. 1 is a diagrammatic view in vertical axial cross section of an indicator light in accordance with the invention.

The indicator light shown in the drawings, and to be described below, is one which is adapted to emit light over a field of reduced dimensions, and in this example it is a winking indicator light of a motor vehicle direction indicator. The field of illumination concerned is for example circular, and has a diameter of the order of 5 centimetres.

In a manner which is conventional per se, the indicator light comprises a lamp 10 having a filament 11, a flux recuperating reflector 20, an intermediate screen 30, and a closure glass or lens 40, which is preferably smooth on both faces, but which may if desired by slightly striated.

The reflector 20 is in the form of a paraboloid of revolution, the axis of which defines the general direction of emission, with its focus lying on the filament 11. In the present example, this basic paraboloid has a focal length of 16 mm and a diameter of about 5 cm. The focus of the paraboloid is indicated at F in FIG. 3. A set of horizontal striations, for processing the light in the vertical direction, is projected on this base surface.

In practical terms, the design of the reflector involves the definition of a plurality of striations in a plane at right angles to the axis of the paraboloid, so as to obtain the required deviations, and the projection of these striations on the paraboloid with reference to the axis of the latter, so that it is the reflector that effects the above mentioned deviations. For various reasons, and in particular for aesthetic reasons, these striations are preferably all of substantially the same height.

When in the remainder of this document geometric parameters of the striations, such as radius and level, are mentioned, these imply reference to the striations.

More precisely, the reflector can be sub-divided into an upper zone, a central zone and a lower zone, the respective functions of which will be explained below.

Figure 3:
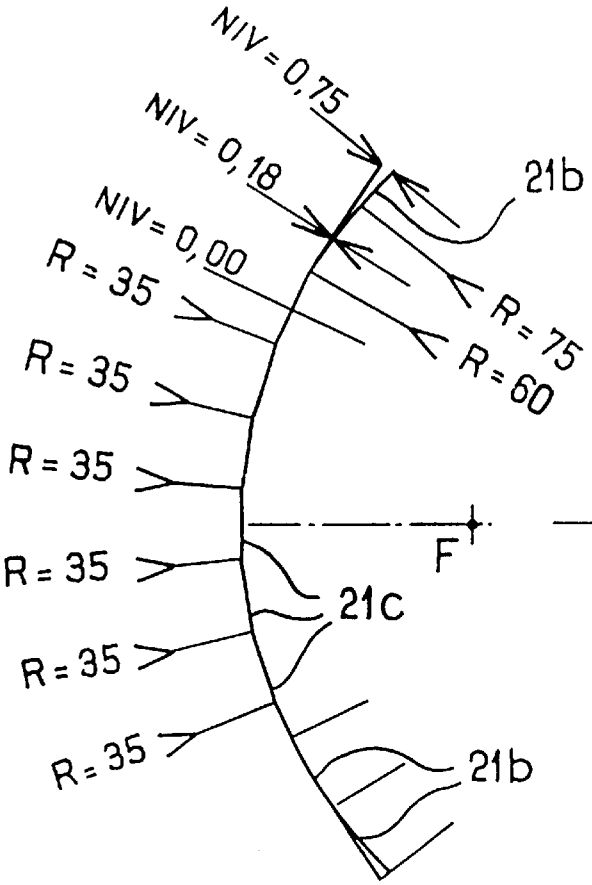
FIG. 3 is a view in vertical axial cross section, on an enlarged scale showing the reflector of the indicator light of FIGS. 1 and 2.

The upper zone comprises in this example two striations 21*h* which are evolved from striations consisting of concave cylindrical surfaces that are applied on prisms, in such a way as to cause the reflected light to be directed downwardly and, at the same time, to be spread in a vertical direction. More precisely, and as is shown in FIG. 3, these striations 21*h* have respective radii of 75 mm and 60 mm, and are offset in level towards the front (i.e. towards the right in FIG. 3). These offsets pass progressively, going from the bottom towards the top, from 0 mm to 0.18 mm, and then to 0.75 mm.

The central zone comprises striations 21*c*, which are convex, and of which there are six in this example. These striations 21*c* are formed without any prism effect, and they all have the same radius of 35 mm. Finally, the lower zone of the reflector has striations 21*b*, which are formed symmetrically with the striations 21*h*, with reference to the horizontal axial plane.

In this example, the reflector therefore has ten striations, and these may for example consist of striations of 5 mm in height on a mirror having a diameter of 50 mm.

Figure 7:
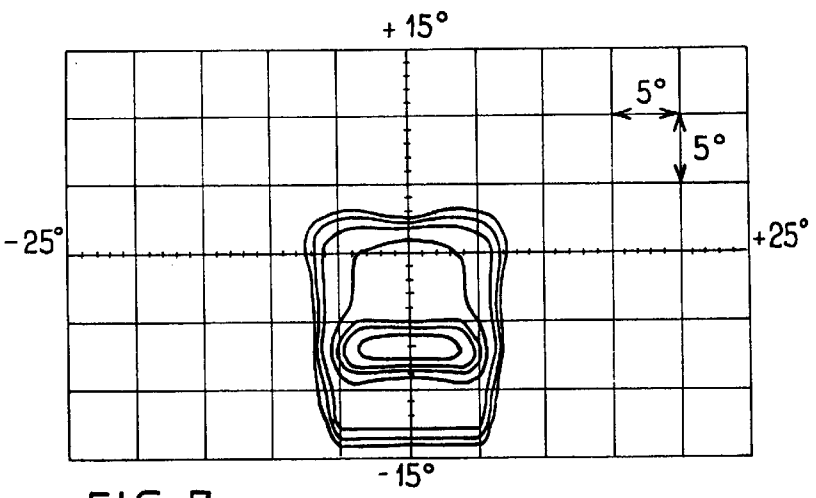
Figure 11:
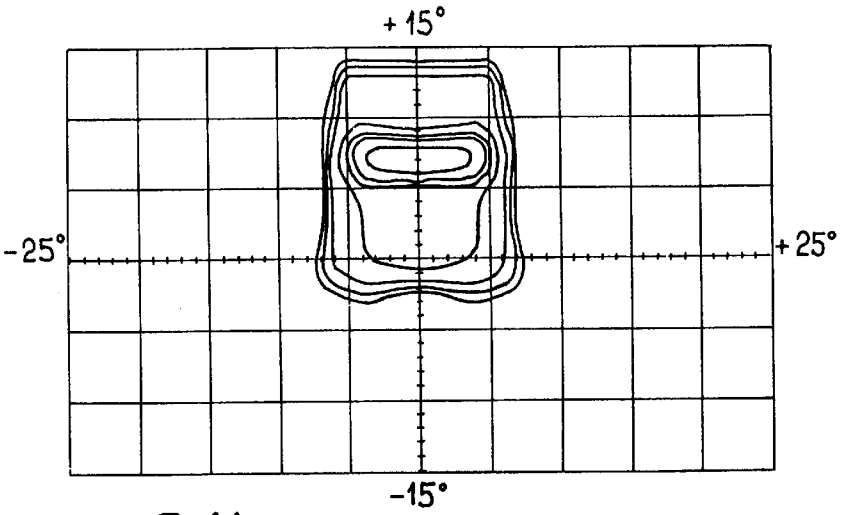

As is shown in FIG. 1, a reflector is thus formed in which its upper zone reflects the light while spreading it homogenously between two planes, the downward inclinations of which, with respect to the horizontal, are about 5° and about 10° respectively. In this connection see FIG. 7, which illustrates the light distribution in the beam formed by the upper zone of the reflector in the absence of the intermediate screen. Symmetrically, the lower zone of the reflector redirects the light by spreading it homogeneously between two planes, and the upward inclinations with respect to the horizontal are of about 5° and 10° for these two planes respectively. As to this, FIG. 11 illustrates the light distribution in the beam formed by the lower zone of the reflector in the absence of the intermediate screen.

Figure 9:
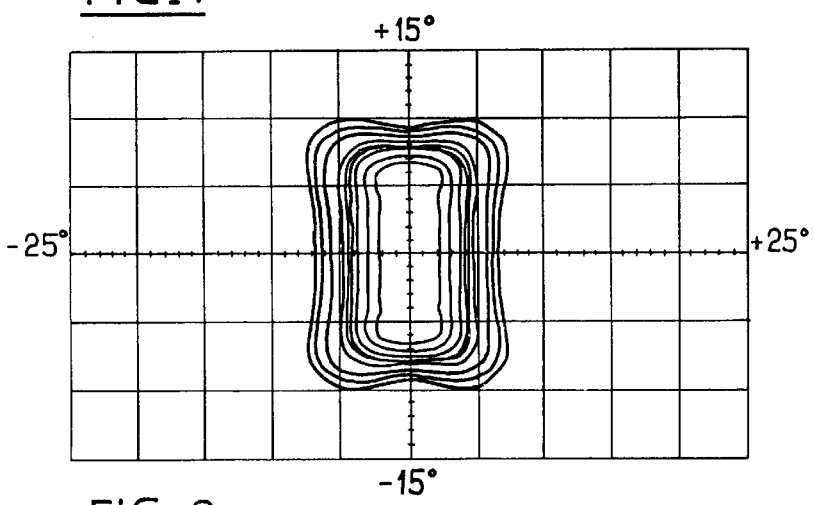

Finally, the central zone of the reflector spreads the light vertically between two planes which are inclined by about −8° and +8° respectively with respect to the horizontal. This is illustrated in FIG. 9, which shows the light distribution in the beam formed by the central zone of the reflector in the absence of the intermediate screen.

Thus the upper and lower zones enable the light to reach the normal photometric measuring points at −10° and +10° below and above the centre of the beam, in the case of a winking direction indicator beam. The central zone, in conjunction with the upper and lower zones, fills homogeneously the gap between these two limits.

It will be observed here that, due to the contours of the radiation which is reflected by the convergent reflector in a vertical plane towards the intermediate screen 30, the reflector may, with advantage, have, in a manner not shown, a height which is greater than that of the intermediate screen that defines the field of illumination, so as thereby to increase the recuperation of light flux emitted by the lamp 10 as compared with a conventional indicator for a given height of illuminating field. In practical terms, the height of the illuminating field can be reduced down to a value of, for example, 40 mm, with this field having an elliptical form. It is also possible to reduce the width of the indicator light, for example down to the same value of 40 mm, by providing a circular illuminating field.

The intermediate screen 30 consists mainly of two portions, namely a central portion which is centred on the axis of the reflector 20 and which is constituted by a Fresnel lens 32, the diameter of which is substantially equal to the diameter of the bulb 10 that constitutes the lamp or light source of the indicator light; and an outer part comprising a set of vertically extending striations 31. Preferably, and mainly for aesthetic reasons, the outer striations 31 are convex, and are formed on the outer face of the intermediate screen 30, the same being true for the ridges that define the Fresnel lens.

Figure 5:
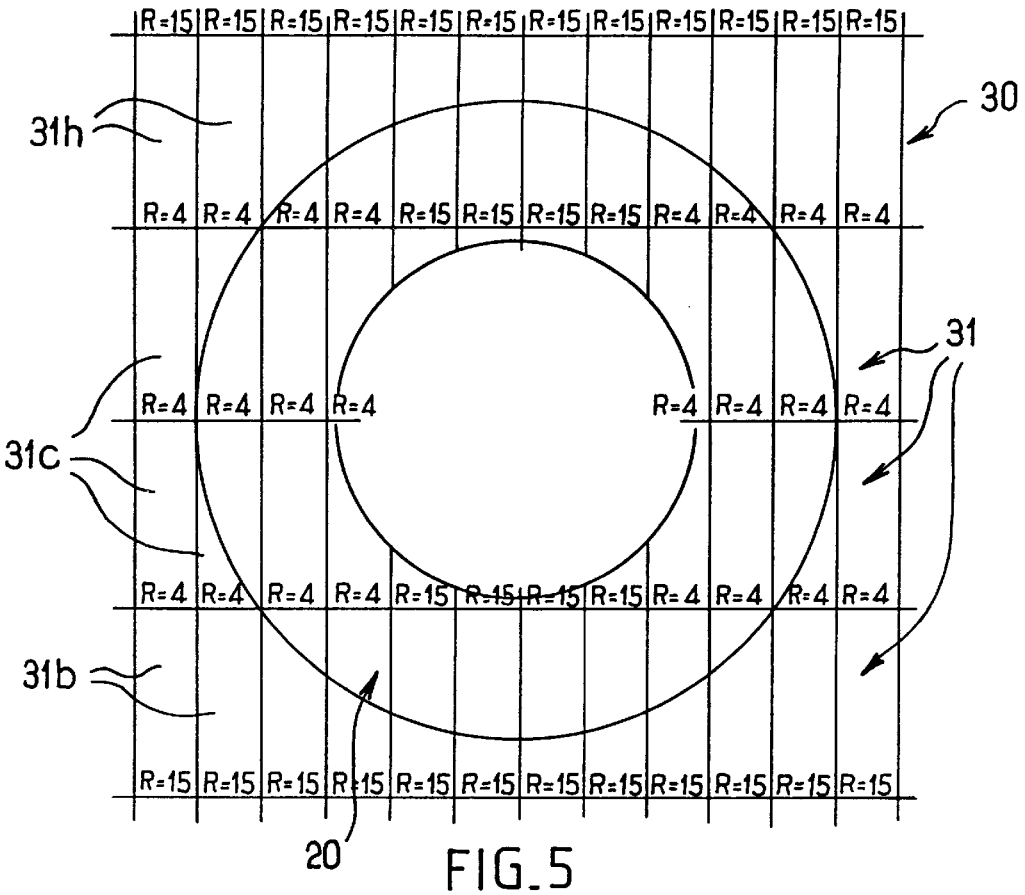
FIG. 5 is a front view on an intermediate screen in the indicator light of FIGS. 1 and 2.
Figure 6:
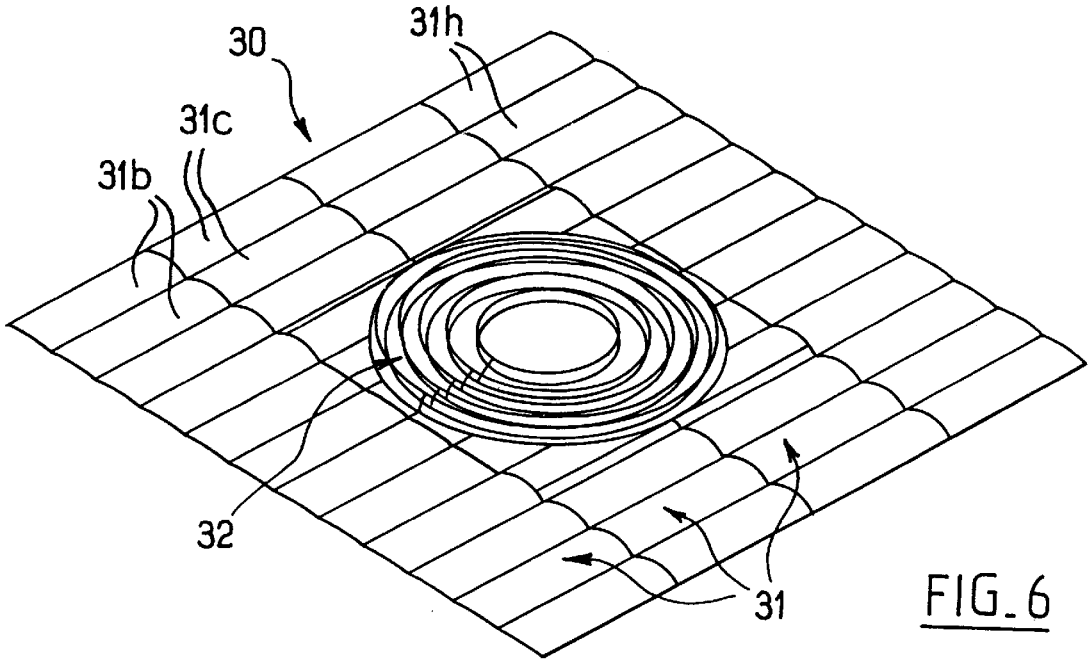
FIG. 6 is a perspective view of the intermediate screen of FIG. 5.

The radii of the different striations in the region of their transitions in horizontal planes are indicated in FIG. 5. As will be seen later herein, certain of the striations have a constant radius (so that they are cylindrical striations), while others have a radius which varies progressively from one vertical end to the other, so that these striations are conical. The striations are preferably all of the same width, for example 5 mm.

The intermediate screen 30 is sub-divided in this respect, as to its outer portion, into three zones. An upper one of these zones has in its central portion cylindrical striations 31*h*, having a radius R of 15 mm, while in the lateral or side portions of this upper zone the striations 31*h* have a radius that varies between a maximum value (R=15 mm) at the top to a minimum value at the bottom (R=4 mm). In this case, the horizontal spreading of the radiation increases progressively going down the length of the striation.

As to the lower zone of the intermediate screen 30, this has striations 31*b* which are disposed, and configured, in a manner symmetrical to the striations 31*h*, with respect to an horizontal axial plane, so that their optical effect is also symmetrical. The height of the central zone of the screen 30 is preferably close to double the height of each of the upper and lower zones taken individually, the central zone having cylindrical striations 31*c* with a radius of 4 mm. This radius is preferably chosen so as to be equal to the adjacent radii of the striations 31*h* and 31*b*, thus giving continuity in the external surface of the intermediate screen 30.

Figure 2:
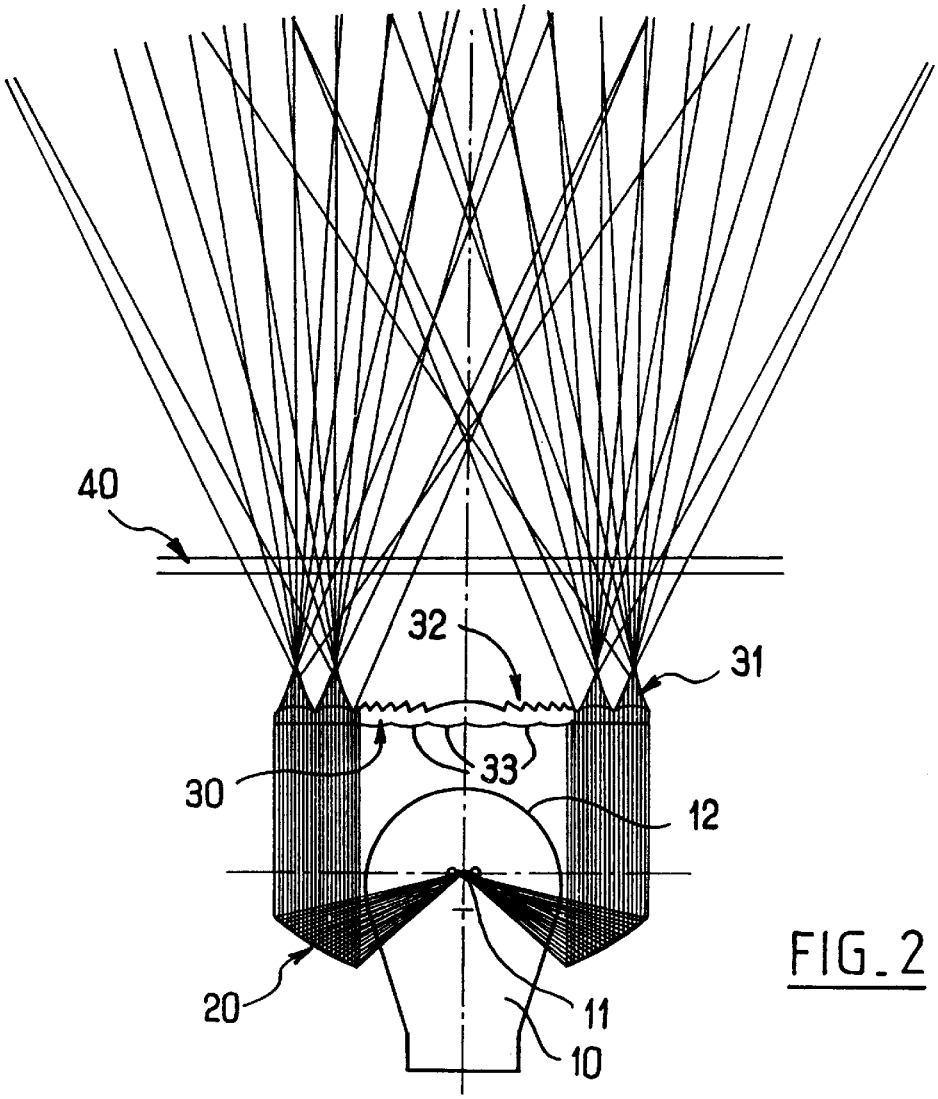
FIG. 2 is a diagrammatic view in horizontal axial cross section of the indicator light of FIG. 1 .
Figure 4:
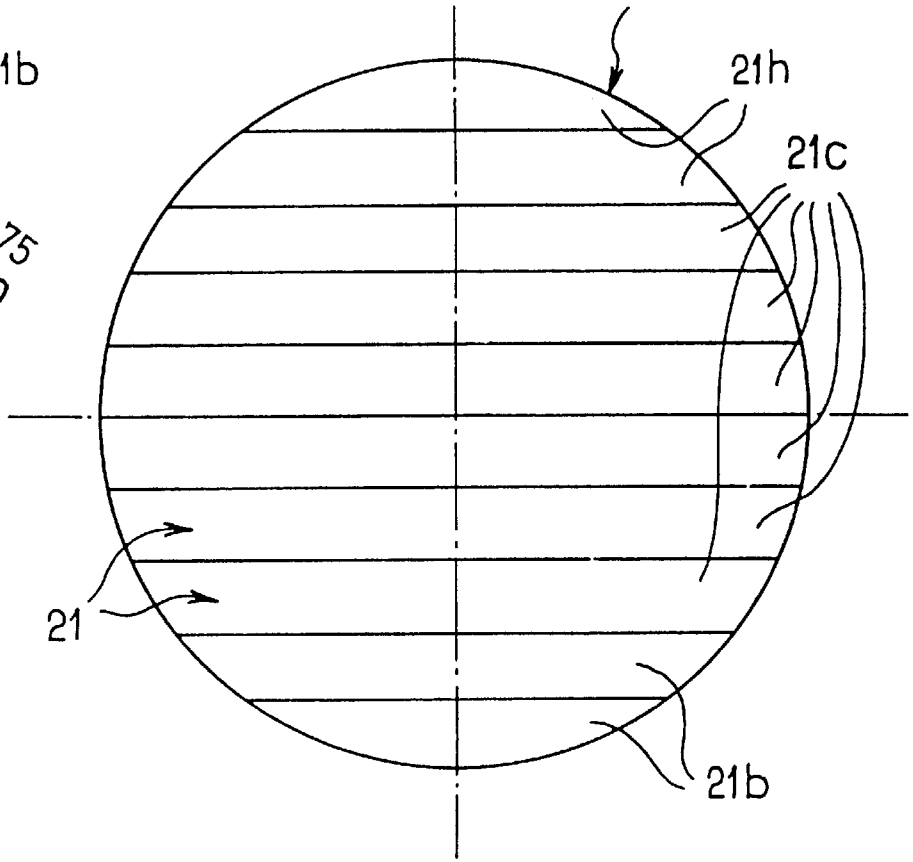
FIG. 4 is a front view of the reflector in FIG. 3.

In addition, and as is shown in FIG. 2, the intermediate screen 30 may have on its inner face, in a region which is limited to that lying immediately behind the Fresnel lens 32, further striations, or projections or toroidal elements 33, for spreading, at least in the horizontal dimension, the direct light emitted by the filament 11 before this light passes through the Fresnel lens.

Figure 8:
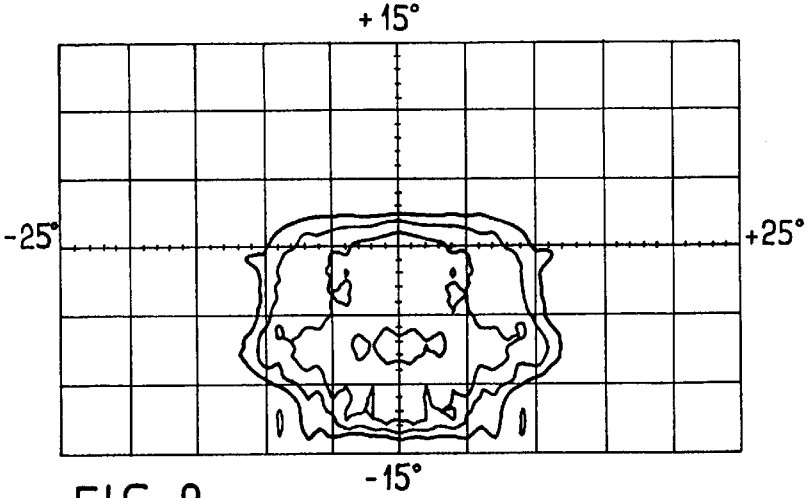
FIGS. 7 to 16 are diagrams showing, by means of isolux curves on a projecting screen, the optical behaviour of the indicator light of FIGS. 1 and 2 and its various optical elements.
Figure 12:
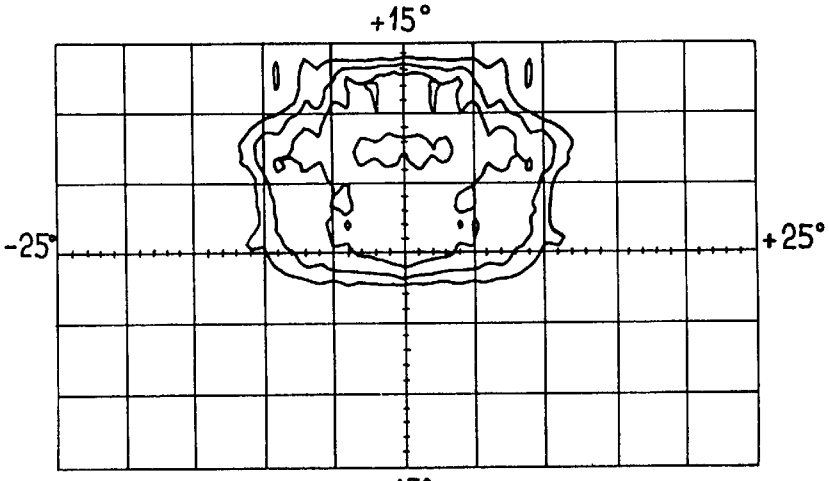

The optical behaviour of the intermediate screen is as follows. The upper and lower zones containing the striations 31*h* and 31*b* provide, in their extreme top and bottom regions respectively, very moderate lateral spreading of the light, so as not to diminish excessively the quanity of steeply inclined light generated by the upper and lower zones of the reflector, which is adapted for satisfying photometric measurements at the points lying at +10° and −10° below the centre of the beam. In this connection, see FIGS. 8 and 12, which illustrate the light distribution in the beam formed by the upper and lower zones of the combination of the reflector 20 with the intermediate screen 30.

Figure 10:
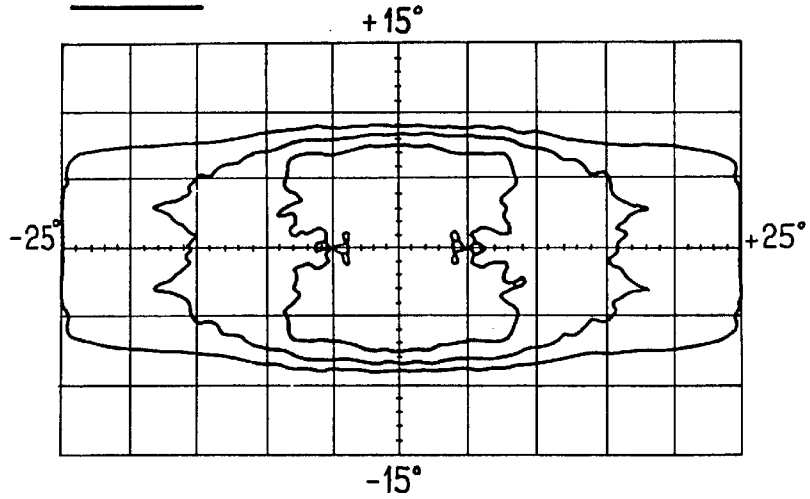

As to the central zone which contains the striations 31*c*, because of the low radius of the latter, this zone provides strong lateral spreading of the radiation that derives mainly from the central portion of the reflector 20, for example over an interval or gap extending from −20° to +20°, thereby forming the body of the beam and satisfying normalised photometric measurements carried out at these angles on either side of the centre of the beam. This is illustrated in FIG. 10, which shows the light distribution that is given by the central zone of the assembly which consists of the reflector 20 and the intermediate screen 30, without the Fresnel lens.

The isolux curves in the remaining Figures that illustrate the behaviour of the beam are as follows.

Figure 13:
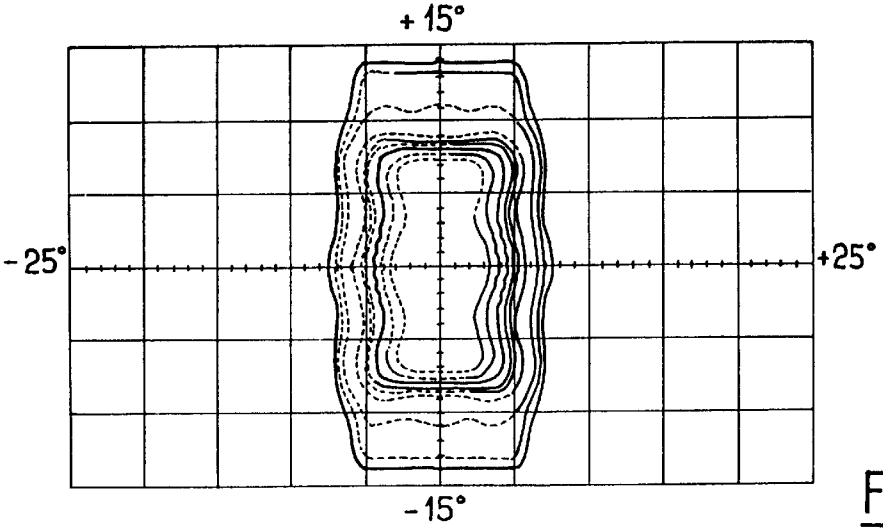
Figure 14:
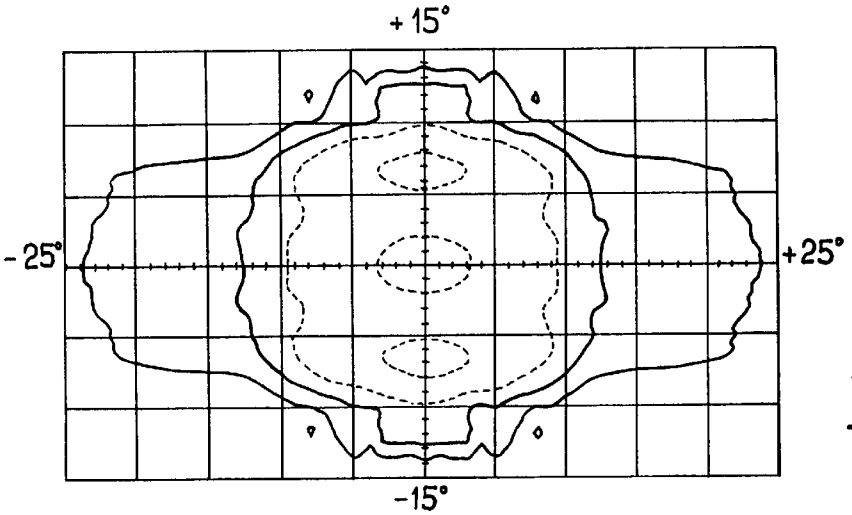
Figure 16:
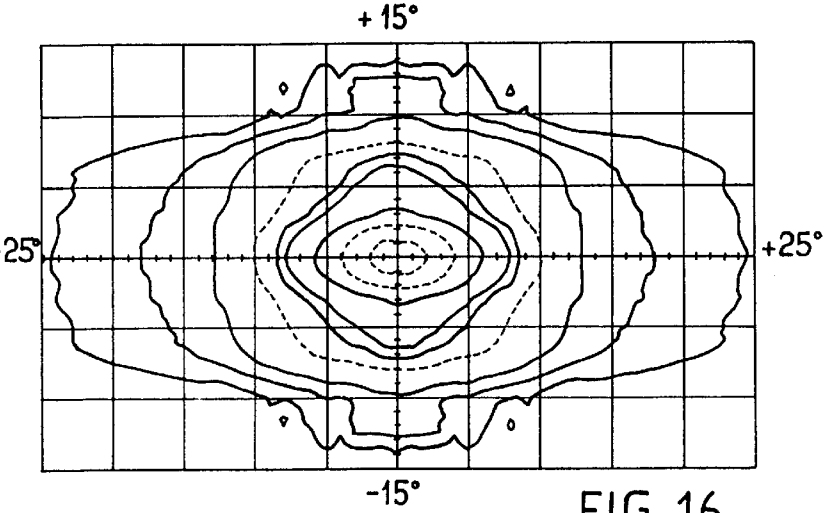
Figure 15:
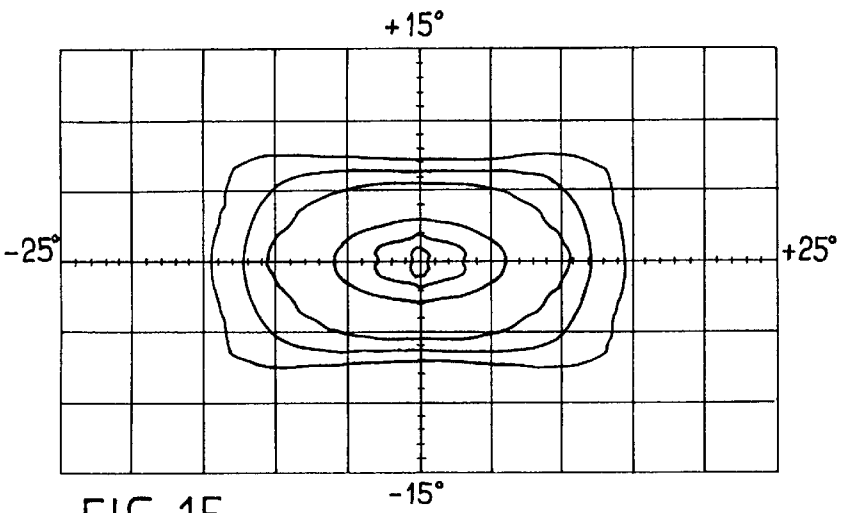

FIG. 13 shows the beam obtained with the whole of the reflector, with the intermediate screen absent. FIG. 14 shows the aspect of the beam which is obtained with the whole of the reflector when the intermediate screen is present. FIG. 15 shows the aspect of the beam obtained with the combination of the Fresnel lens 32 and the associated vertical striations 33 (FIG. 2), while FIG. 16 shows the aspect of the final beam which is generally produced by the indicator light complete.

Thus, because of the arrangement of striations described above, an indicator light is obtained which is able to be compact, both as regards its illuminating field and as regards its depth, with, in particular, a relatively small and shallow reflector, while at the same time satisfying the most rigorous photometric criteria, as is the case in particular for winking direction indicator lights.

The various numerical values given above, which are appropriate for the case of a winking direction indicator light, will of course be adjusted as appropriate for the other types of indicator light that may be used, and in particular for reversing lights, especially according to the legal requirements for photometric performance.

In addition, in another version vertical striations may be provided on the reflector, and horizontal striations on the intermediate screen.

Moreover, the invention enables the field of illumination given by the indicator light to take a large number of different forms, for example elliptical, circular, and so on.

What is claimed is:

1. An indicator light for a motor vehicle, comprising:

a light source, a reflector defining an axis, the light source lying on the axis and the reflector having a plurality of striations defining a first orientation; and an optical plate having a plurality of striations defining a second orientation substantially at right angles to the first orientation, wherein the reflector comprises a central zone and two side zones flanking the central zone, the central zone having striations for spreading the light in a first direction in a given first angular interval defined on either side of the axis of the reflector, with each said side zone of the reflector having striations for spreading the light while directing it towards the axis of the reflector in the first direction, the optical plate having a central zone which is essentially homologous to the central zone of the reflector, the central zone of the optical plate having striations for spreading the light in a second direction substantially at right angles to the first direction, in a given second angular interval defined on either side of the axis of the reflector, the optical plate further having side zones flanking said central zone and being essentially homologous to the side zones of the reflector, each said side zone of the optical plate having striations for spreading the light in the second direction by an amount less than the amount of spreading given by the striations in the central zone of the optical plate.

2. An indicator light according to claim 1, wherein the optical plate is an intermediate screen, the indicator light further including a substantially smooth cover lens.

3. An indicator light according to claim 1, wherein the optical plate constitutes a cover lens for the light, the striations in the optical plate being disposed on its inner face.

4. An indicator light according to claim 1, wherein the striations of the reflector are substantially horizontal, the striations of the optical plate are substantially vertical, and the side zones of the reflector and of the optical plate are upper and lower zones thereof.

5. An indicator light according to claim 4, wherein the striations in the upper zone of the reflector are adapted to divert the light downwardly while spreading it vertically about a descending mean inclination, the striations in the lower zone of the reflector being adapted to divert the light upwardly while spreading it vertically about a rising mean inclination.

6. An indicator light according to claim 5, defining two first planes which are inclined with respect to the horizontal downwardly by about 5 degrees and about 10 degrees respectively, and two second planes which are inclined with respect to the horizontal upwardly by about 5 degrees and about 10 degrees respectively, the striations in the upper zone of the reflector being adapted to put the light substantially between the two said first planes, and the striations in the lower zone of the reflector being adapted to put the light substantially between the two said second planes.

7. An indicator light according to claim 4, defining two planes inclined symmetrically with respect to the horizontal, upwardly and downwardly respectively, the striations in the central zone of the reflector being adapted to put the light substantially between the two said planes.

8. An indicator light according to claim 7, wherein the said symmetrically inclined planes are inclined by substantially 8 degrees on either side of the horizontal.

9. An indicator light according to claim 1, wherein the striations in the central zone of the optical plate are cylindrical striations of constant radius.

10. An indicator light according to claim 9, wherein the striations in the side zones of the optical plate have a radius which increases progressively towards the associated outer edge of the optical plate.

11. An indicator light according to claim 10, wherein the striations in the central zone of the optical plate have a radius equal to a minimum radius of the adjacent striations in the side zones of the same plate, the said striations being aligned with each other.

12. An indicator light according to claim 1, wherein the optical plate further includes a Fresnel lens aligned with the light source.

13. An indicator light according to claim 12, wherein the optical plate further includes, in association with the Fresnel lens, further light spreading means.

14. An indicator light according to claim 1, wherein one of the dimensions consisting of the horizontal dimension and the vertical dimension of the reflector is greater than the corresponding dimension of at least a working part of the optical plate.

15. An indicator light, comprising:

a light source, a reflector defining an axis, the light source lying on the axis and the reflector having a plurality of striations defining a first orientation;

an optical plate having a plurality of striations defining a second orientation substantially at right angles to the first orientation, wherein the reflector comprises a central zone and two side zones flanking the central zone, the central zone having striations for spreading the light in a first direction in a given first angular interval defined on either side of the axis of the reflector, with each said side zone of the reflector having striations for spreading the light while directing it towards the axis of the reflector in the first direction; and wherein the optical plate having a central zone which is essentially homologous to the central zone of the reflector.

16. The indicator light of claim 15, wherein the central zone of the optical plate has striations for spreading the light in a second direction substantially at right angles to the first direction.

17. The indicator light of claim 16, wherein the optical plate further having side zones flanking said central zone and being essentially homologous to the side zones of the reflector.

18. The indicator light of claim 17, wherein each said side zone of the optical plate having striations for spreading the light in the second direction by an amount less than the amount of spreading given by the striations in the central zone of the optical plate.

19. The indicator light of claim 15, wherein said optical plate containing side zones having striations for spreading the light in the second direction by an amount less that the amount of spreading given by striations in the central zone fo the optical plate.

* * * * *